US006472118B1

(12) United States Patent
Yamaguchi et al.

(10) Patent No.: US 6,472,118 B1
(45) Date of Patent: Oct. 29, 2002

(54) CARRIER FOR DEVELOPER FOR ELECTROPHOTOGRAPHY

(75) Inventors: Kimitoshi Yamaguchi; Akihiro Kotsugai, both of Numazu (JP)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 09/713,201

(22) Filed: Nov. 16, 2000

(30) Foreign Application Priority Data

Nov. 17, 1999 (JP) ..... 11-327393

(51) Int. Cl.[7] ..... G03G 9/00

(52) U.S. Cl. ..... 430/111.35; 430/111.4; 430/111.41

(58) Field of Search ..... 430/111.35, 111.4, 430/111.41

(56) References Cited

U.S. PATENT DOCUMENTS

| | | | | |
|---|---|---|---|---|
| 4,908,290 A | | 3/1990 | Watanabe et al. | |
| 4,956,258 A | | 9/1990 | Watanabe et al. | |
| 5,168,028 A | | 12/1992 | Nanya et al. | |
| 5,288,557 A | | 2/1994 | Yamaguchi et al. | |
| 5,368,972 A | | 11/1994 | Yamashita et al. | |
| 5,429,901 A | | 7/1995 | Muto et al. | |
| 5,491,042 A | * | 2/1996 | Sato et al. | 430/111.35 |
| 5,512,402 A | * | 4/1996 | Okado et al. | 430/111.4 |
| 5,882,832 A | | 3/1999 | Tosaka et al. | |
| 6,004,715 A | | 12/1999 | Suzuki et al. | |
| 6,010,814 A | | 1/2000 | Kotsugai et al. | |
| 6,074,794 A | | 6/2000 | Fushimi et al. | |
| 6,074,795 A | | 6/2000 | Watanabe et al. | |
| 6,103,441 A | | 8/2000 | Tomita et al. | |
| 6,180,298 B1 | | 1/2001 | Kuroda et al. | |
| 6,183,926 B1 | | 2/2001 | Kuroda et al. | |
| 6,228,550 B1 | | 5/2001 | Matsuda et al. | |
| 6,258,502 B1 | | 7/2001 | Nakamura et al. | |
| 6,303,257 B1 | | 10/2001 | Hasegawa et al. | |
| 6,303,258 B1 | | 10/2001 | Katoh et al. | |

* cited by examiner

*Primary Examiner*—Mark Chapman
(74) *Attorney, Agent, or Firm*—Oblon, Spivak, McClelland, Maier & Neustadt, P.C.

(57) ABSTRACT

A carrier for an image developer for electrophotography, including core particles, and a coating layer covering each of the core particles, wherein the core particles have a weight average particle diameter of Dv which is 25–45 $\mu$m and a number average particle diameter of Dp which meets with the following condition:

$$1 \leqq Dv/Dp \leqq 1.3,$$

wherein the core particles have such a particle size distribution that particles having a particle diameter of less than 44 $\mu$m is at least 70% by weight and particles having a particle diameter of less than 22 $\mu$m is not more than 7% by weight.

14 Claims, 1 Drawing Sheet

CARRIER FOR DEVELOPER FOR ELECTROPHOTOGRAPHY

BACKGROUND OF THE INVENTION

This invention relates to a carrier for an image developer, to an electrostatic latent image developer, to an image forming apparatus by electrophotography, electrostatic recording or electrostatic printing, to an image developing method and to a method of preparing a carrier.

In electrophotography, an electrostatic latent image formed on a photosensitive medium is developed by a developer. One-component developers composed of a toner and two-component developers composed of a toner and a carrier, such as glass beads and magnetic particles with or without resin coating, are known as the developer. The latter, two-component developers are suitably used for high speed printing and copying machines. In electrophotography of a digital-type in which a photoconductor is irradiated with a laser beam to form an electrostatic latent image, two-component developers are generally used for developing the latent image.

Recently, there is an increasing demand for a developer which can meet with requirements for high resolution, improved reproducibility in highlight and multi-color images. Thus, minimization of a minimum unit of latent images and high density thereof are desired. Accordingly, there is a great demand for a developing system which can accurately and precisely developing such a dot image. To attain this demand, various proposals have been made from the standpoint of both process conditions and developers (toners and carriers).

As to process conditions, minimization of developing gap, use of a thin film photoconductor and reduction of a beam diameter for writing are considered to be effective. However, these measures pose a problem of cost increase and reduction of reliability.

As for developers, the use of a small size toner will greatly improve the reproducibility of dot images but, in this case, occurrence of background stains and reduction of color density are caused. Additionally, when a small size toner is used for full color image formation in which a low softening point resin binder is used, adhesion of toner on the surface of the carrier occurs significantly. Thus, the developer is deteriorated during use to cause toner dispersion and background stains.

The use of a small size carrier will give the following merits.

(1) Because of a large surface area, every toner can be sufficiently charged by friction so that the formation of a low charging amount toner or a reversed charged toner can be minimized. Thus, background stains and toner dispersion or blurs of a dot image can be reduced so that the dot image reproducibility is improved.

(2) Because of a large surface area and reduced background stains, it is possible to reduce average charging amount of the toner. As a consequence, a high image density is obtainable. The use of a small size carrier can thus compensate demerits of a small size toner and is effective for obtaining desired properties of the small size toner.

(3) A small size carrier can form a dense but soft magnetic brush. Thus, a mark of brush is hardly formed in images.

In the case of known small size carriers, however, deposition or adhesion of carriers on a photoconductor is apt to occur during the developing stage so that injury of the photoconductor or an image fixing roller which is in contact with the photoconductor is apt to be caused.

SUMMARY OF THE INVENTION

In accordance with one aspect of the present invention, there is provided a carrier for an image developer for electrophotography, which comprises core particles, and a resin layer covering each of the core particles, wherein the core particles have a weight average particle diameter of Dv which is 25–45 μm and a number average particle diameter of Dp which meets with the following condition:

$$1 \leqq Dv/Dp \leqq 1.3,$$

wherein at least 70% by weight of the core particles have a particle diameter of less than 44 μm, and wherein the amount of the core particles having a particle diameter of less than 22 μm is no more than 7% by weight.

In another aspect, the present invention provides a developer for electrophotography, which comprises a dry toner, and the above carrier.

In a further aspect, the present invention provides a method of developing an electrostatic latent image, which comprises contacting the latent image with the above developer.

The present invention further provides a developer container containing the above developer.

The present invention further provides an image forming apparatus having mounted thereon the above developer container.

The present invention further provides a method of preparing a carrier, which comprises the steps of:

sieving a carrier core material using an ultrasonically vibrated sieve to obtain core particles having a content of particles having a particle diameter of 22 μm or less of 3% by weight or less; and coating the core particles with a resin.

The present invention further provides a method of preparing a carrier, comprising the steps of:

coating core particles with a resin; and sieving said coated core particles using an ultrasonically vibrated sieve to obtain carrier particles having a content of particles having a particle diameter of 22 μm or less of 3% by weight or less.

It is an object of the present invention to provide a carrier for a two-component developer for electrophotography, which has excellent durability, which causes little carrier deposition and which can afford high quality images.

Another object of the present invention is to provide a two-component developer for electrophotography which can afford high density images free of background stains, which can give, with good highlight reproducibility, dot images having small variation of dot diameters and which can give images free of brush marks.

BRIEF DESCRIPTION OF THE DRAWINGS

Other objects, features and advantages of the present invention will become apparent from the detailed description of the preferred embodiments of the invention which follows, when considered in light of the accompanying drawings in which.

DETAILED DESCRIPTION OF THE PREFERRED EMBODIMENTS OF THE INVENTION

Figure 1:
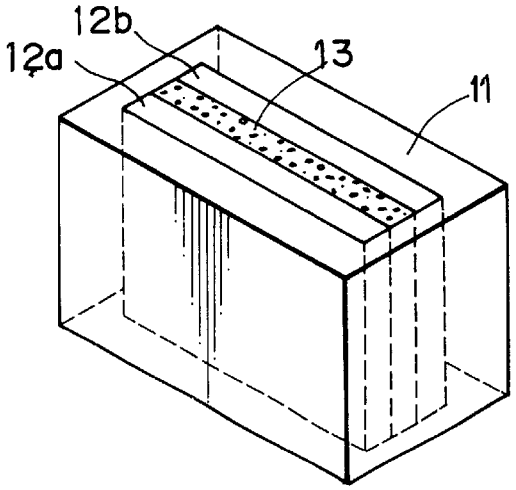
FIG. 1 is a perspective view diagrammaticaly illustrating a cell used for measuring electric resistance of carrier particles.

The carrier according to the present invention comprises a core material, and a coating layer covering the core material. The core particles have a weight average particle diameter Dv and a number average particle diameter Dp. The particle diameter may be measured with a particle diameter analyzer (MICROTRAC HRA Particle Diameter Analyzer Model No. 9320-X100 manufactured by Honeywell Inc.; NIKKISO Catalog No. 3112-R5). Particle diameter range (e.g. 12–80 μm) of a sample is divided by a 2 μm interval into channels (e.g. 36 channels) and the number (frequency) of particles in each channel is counted. The representative particle diameter in each channel may be, for example, the minimum particle diameter in that channel. The weight average particle diameter Dv and number average particle diameter Dp may be defined as follows:

$$Dv=\{1/\Sigma(nD^3)\}\times\{\Sigma(nD^4)\}$$

$$Dp=(1/N)\times\{\Sigma(nD)\}$$

wherein

D: representative particle diameter in each channel

N: total number of particles measured n: number of particles in each channel.

It is important that the core particles have a weight average particle diameter Dv of 25–45 μm. From the standpoint of prevention of occurrence of carrier deposition on a photoconductor, a greater weight average particle diameter is more preferred. With a weight average particle diameter Dv of greater than 45 μm, however, background stains are significant caused, especially when the content of a toner in the developer is high. In addition, a weight average particle diameter Dv in excess of 45 μm will cause a large variation of the dot diameter, especially when the diameter of a dot latent image is small. Thus, dot image reproducibility becomes poor. Furthermore, such a high weight average particle diameter Dv is apt to cause formation of marks of the brush in developed images.

It is also important that the amount of those core particles which have a particle diameter of less than 22 μm should be no more than 7% by weight based on the weight of the entire core particles, preferably no more than 3% by weight. It has been found that carrier deposition becomes significant when the particle diameter of the core particles is less than 22 μm. When the content of core particles having a particle diameter of less than 22 μm is not more than 7% by weight, however, the core deposition can be neglected.

It is further important that at least 70% by weight of the core particles have a particle diameter of less than 44 μm and that the number average particle diameter Dp of the core particles should meet with the following condition: $1 \leqq Dv/Dp \leqq 1.3$. When the particle diameter distribution of the core particles is sharp and meets with the above conditions, variation of the dot diameter is reduced and, therefore, dot image reproducibility becomes excellent. Additionally, carrier deposition can be prevented and high quality images can be obtained.

Any conventionally employed core material for two-component developers may be used for the purpose of the present invention. Illustrative of suitable core materials are ferrite, magnetite, iron and nickel. It is preferred that the core particles provide an induced magnetic moment of at least 60 emu/g, more preferably at least 75 emu/g, when in an applied magnetic field of 1 KOe (1000 Oersteds), for reasons of prevention of carrier deposition. When the magnetic moment of the core particles is small, the carrier particles forming a magnetic brush on a rotating developing roller or sleeve are apt to liberate therefrom and migrate to a photoconductor due to centrifugal force. Additionally, because of the counter charges on the carrier particles, the carrier particles are prone to transfer onto edges of black or solid patterns or onto the background. Thus, carrier deposition problems are apt to be caused. The use of core particles providing a magnetic moment of at least 60 emu/g is effective in prevention of such carrier deposition problems.

Examples of carrier core materials providing a magnetic moment of at least 60 emu/g when applied with a magnetic field of 1 KOe include ferromagnetic materials such as iron and cobalt, magnetite, hematite, Li ferrite, Mn—Zn ferrite, Cu—Zn ferrite, Ni—Zn ferrite, Ba ferrite and Mn ferrite. Examples of carrier core materials providing a magnetic moment of at least 75 emu/g when applied with a magnetic field of 1 KOe include Fe, magnetite, Mn—Mg ferrite and Mn ferrite. Ferrite is a sintered material generally represented by the formula:

$$(MO)_x(NO)_y(MO)_x(Fe_2O_3)_z$$

wherein x+y+z=100 mol %, and M and N are metals such as Li, Sr, Ca, Mg, Ba, Cu, Zn, Mn, Fe, Ni and Cd.

The magnetic moment of carrier core particles may be measured with B-H Tracer (model BHU-60 manufactured by Riken Denshi Kabushiki Kaisha). A sample (1.0 g) is filled in a cylindrical cell and subjected to varying magnetic field. Thus, the magnetic field is gradually increased to 3,000 Oersteds and then gradually decreased to zero (initial stage). Thereafter, a magnetic field is applied in the opposite direction. Thus, the magnetic field is gradually increased to 3,000 Oersteds and then gradually decreased to zero (second stage). Subsequently, a magnetic field is gradually increased to 3,000 Oersteds in the same direction as in the initial stage (third stage). A B-H curve is prepared through the first to third stages. The magnetic moment at an applied magnetic field of 1000 Oersteds in the third stage is determined from the B-H curve. The magnetic moment may also be measured with Rotating Extraction Magnetometer (Model REM-1 manufactured by Toei Kogyou Kabushiki Kaisha).

The carrier core particles having the above pore size characteristics may be prepared by air classification or sieve classification. With the air classification, however, the yield of the desired particles is very low. With the sieve classification, meshes of the small sieve openings are apt to be clogged. Thus, it is necessary to clean the sieve repeatedly. Further, the clogged meshes are not easily cleaned.

It has been found that the use of an ultrasonically vibrated sieve is effective for preparing carrier core particles having the desired characteristics.

Figure 2:
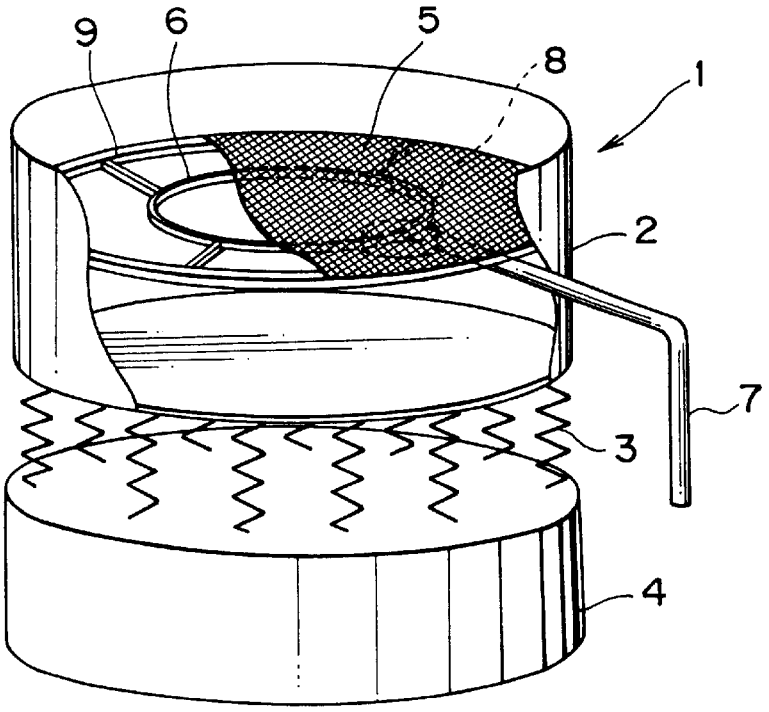
FIG. 2 is a perspective view diagrammaticaly illustrating an ultrasonic vibration sieving device used for carrying out a method of preparing a carrier according to the present invention.

FIG. 2 depicts an ultrasonically vibrated sieve device useful for carrying out the sieve classification. The sieve device 1 has a cylindrical casing 2 supported on a base 4 through a cushioning member 3 such as springs. mounted within the casing 2 is a wire net sieve 5 which is supported on a frame 9 secured to the casing 2. A resonant ring 6 is directly attached to the wire net sieve 5 so that the vibration of the resonant ring 6 is transmitted to the sieve 5. Designated as 8 is a converter secured to the resonant ring 6 and adapted to generate an ultrasonic wave of for example 36 kHz upon receipt of a high frequency current through a cable 7 connected to a high frequency current generator (not shown) accommodated within the base 4. With the above sieving device, the sieve 5 is vertically vibrated throughout the whole area thereof by the vibration of the resonant ring 6, so that raw material particles placed on the sieve 5 are ultrasonically sieved with high efficiency without causing clogging. Further, since the resonant ring 6 supports the sieve 5 in a wide area, the service life of the sieve 5 is improved. The sieve may be 500 mesh (sieve opening: 25 μm) or 600 mesh (opening: 20 μm).

The carrier core particles are each coated with a resin layer. Any binder customarily used for coating a core material of carriers may be employed in the present invention. Examples of the binder include silicone resins, polystyrene resins (e.g. polystyrene, chloropolystyrene, poly-α-methylstyrene, styrene-chlorostyrene copolymers, styrene-propylene copolymers, styrene-butadiene copolymers, styrene-vinyl chloride copolymers, styrene-maleic acid copolymers, styrene-acrylate copolymers (acrylate may be for example methyl acrylate, ethyl acrylate, butyl acrylate, octyl acrylate or phenyl acrylate), styrene-methacrylate copolymers (methacrylate may be for example methyl methacrylate, ethyl methacrylate, butyl methacrylate, octyl methacrylate or phenyl methacrylate), styrene-methyl α-chloroacrylate copolymers and styrene-acrylonitrile-acrylate copolymers), epoxy resins, polyester resins, polyolefin resins (e.g. polyethylene resins and polypropylene resins), ionomer resins, polyurethane resins, ketone resins, ethylene-ethylacrylate resins, xylene resins, polyamide resins, phenol resins, polycarbonate resins, melamine resins, polyacrylic resins, polymethacrylic resins, polyether resins, polysulfinic acid resins, polybutyral resins, urea resins, urethane-urea resins, teflon resins, copolymers thereof including block copolymers and graft copolymers, and mixtures thereof.

The preferred binder resin is a silicone resin or a mixture thereof with the above-described resins. The silicone resin may be, for example, a compound having recurring units represented by any one of the following formulas:

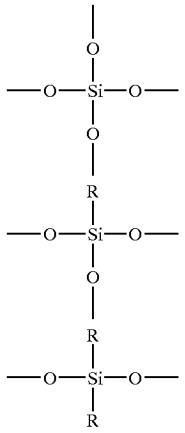

wherein R represents a hydrogen atom, a halogen atom, a hydroxyl group, a methoxyl group, a lower alkyl group having 1–4 carbon atoms or a phenyl group.

The silicone resin may be a straight silicone resin or a modified silicone resin. Illustrative of straight silicone resins are KR271, KR272, KR282, KR252, KR255, KR152 (products of Shinetsu Chemical Industry Co., Ltd.), SR2400 and SR2406 (products of Toray Dow Corning Silicone Inc.). The modified silicone resin may be, for example, epoxy-modified silicone, acryl-modified silicone, phenol-modified silicone, urethane-modified silicone, polyester-modified silicone or alkyd-modified silicone. Illustrative of modified silicone resins are ES-1001N (epoxy-modified), KR-5208 (acryl-modified), KR-5203 (polyester-modified), KR-206 (alkyd-modified), KR-305 (urethane-modified) (above are products of Shinetsu Chemical Industry Co., Ltd.), SR2115 (epoxy-modified) and SR2110 (alkyd-modified) (products of Toray Dow Corning Silicone Inc.).

One or more silane coupling agents may also be added in the silicone resin-containing coating layer to improve dispersibility and solubility. Silane coupling agent represented by the following general formula may be suitably used:

$$X—Si(R^1)_m(OR)_n$$

wherein X is either a functional group which is reactive or adsorbent to either organic or inorganic materials or a saturated or unsaturated hydrocarbon chain with such a functional group as described above, R represents a hydrocarbyl group, OR is an alkoxyl group, m is an integer of 0–2 and n is an integer of from 1 to 3. As the silane coupling agent, an aminosilane coupling agent having an amino group as the X group is preferably used in the present invention. Examples of aminosilane coupling agents are given below together with the molecular weight thereof:

| | |
|---|---|
| $H_2N(CH_2)_3Si(OCH_3)_3$ | MW: 179.3 |
| $H_2N(CH_2)_3Si(OC_2H_5)_3$ | MW: 221.4 |
| $H_2N(CH_2)_3Si(CH_3)_2OC_2H_5$ | MW: 161.3 |
| $H_2N(CH_2)_3SiCH_3(OC_2H_5)_2$ | MW: 191.3 |
| $H_2N(CH_2)_2NHCH_2Si(OCH_3)_3$ | MW: 194.3 |
| $H_2N(CH_2)_2NH(CH_2)_3SiCH_3(OCH_3)_2$ | MW: 206.4 |
| $H_2N(CH_2)_2NH(CH_2)_3Si(OCH_3)_3$ | MW: 224.4 |
| $(CH_3)_2N(CH_2)_3SiCH_3(OC_2H_5)_2$ | MW: 219.4 |
| $(C_4H_9)_2N(CH_2)_3Si(OCH_3)_3$ | MW: 291.6 |

The resin layer may be formed by any conventional method such as spray drying, immersion, powder coating, fluidized bed coating. The fluidized bed coating is preferably used for forming a resin layer having a uniform thickness. The resin layer preferably has a thickness of 0.02–1.0 μm, more preferably 0.03–0.8 μm. When the resin layer has such a small thickness as defined immediately above, the volume average particle diameter is scarcely changed before and after the coating of the resin layer over the core particles.

It is preferred that the carrier have an electric resistance LogR of 14.0 Ω·cm or less for reasons of prevention of carrier deposition and higher image density. The resistance of the carrier may be controlled by adjusting the resistance and/or thickness of the resin coating layer thereof. Addition of an electrically conductive fine powder can adjust the resistance of the carrier. Illustrative of suitable conductive powders are conductive metal or metal oxide such as ZnO, Al, $SnO_2$, metal-doped $SnO_2$, borate such as $TiB_2$, $ZnB_2$ and $MoB_2$, conductive polymers such as polyacetylene, poly-p-phenylene, poly(p-phenylenesulfide)polypyrrol and polyethylene, and carbon black such as furnace black, acetylene black and channel black.

The carrier resistance may be measured using a cell as shown in FIG. 1. Designated as 11 is a fluorine resin cell in which a pair of spaced apart electrodes 12*a* and 12*b* are disposed to define a predetermined gap of 2 mm. Each of the electrodes 12*a* and 12*b* has a length of 40 mm and a height of 20 mm. In the gap, carrier particles 13 are filled. Between the electrodes 12*a* and 12*b*, a DC voltage of 100 V is applied. Resistance R (Ω·cm) is measured with a high resistance meter (Model 4329A manufactured by Yokokawa Hewlett Packard Inc.) from which LogR is calculated.

If desired, one or more other powder additives, such as dyes, pigments and magnetic materials may be incorporated into the resin layer. Incorporation of the conductive powder or other additives into the resin layer may be carried out by, for example, dispersing the additive in a coating liquid containing the binder resin using a ball mill, a beads mill or a stirrer having stirring blades, and coating the carrier core particles with the resulting dispersion.

The carrier thus constructed is combined with a dry toner to form a two components developer. In general, the toner is used in an amount of 0.5 to 15% by weight based on a total weight of the toner and the carrier.

The charging amount of the toner is generally not greater than 50 $\mu$c/g, preferably not greater than 35 $\mu$c/g, when used in such an amount as to provide a covering ratio of 50%. When the charging amount of the toner is excessively high, a sufficiently high image density is not obtainable. Further, because of counter charge built-up on carrier particles, carrier particles are apt to adhere to edges of black images.

The term "covering ratio" used in the present specification refers to a proportion of toner particles of the developer relative to carrier particles of the developer in terms of percentage calculated by the following equation:

$$\text{Covering Ratio } (\%)=(Wt/Wc)\times(\rho_c/\rho_t)\times(Dc/Dt)\times(1/4)\times 100$$

wherein

Wt: amount of the toner particles (g)

Wc: amount of the carrier particles (g)

$\rho_c$: true specific gravity of the carrier particles (g/cm$^3$)

$\rho_t$: true specific gravity of the toner particles (g/cm$^3$)

Dc: weight average particle diameter of the carrier particles

Dt: weight average particle diameter of the toner particles.

The toner preferably has a weight average particle diameter of not greater than 6.0 $\mu$m. The use of such a small particle size toner in conjunction with the above carrier can prevent carrier deposition and can give high quality images with good dot image reproducibility without background stains.

The toner generally contains a binder resin such as a thermoplastic resin, a coloring agent and, optionally, additive particulates such as a charge controlling agent and a releasing agent. The toner may be prepared by any suitable known method including, for example, polymerization, pulverization and classification with air classifier. Both magnetic and non-magnetic toner may be used.

The binder resins include polystyrene resins, polyester resins, epoxy resins, polymethyl acrylate, polybutyl methacrylate, polyvinylchloride, polyvinylacetate, polyethylene, polypropylene, polyurethane, polyvinylbutyral, polyacrylic resins, rosin, modified rosin, terpene resins, phenol resins, aliphatic resins, aliphatic hydrocarbon resins, aromatic petroleum resins, chlorinated paraffin and paraffin wax.

Examples of the polystyrene resins include polystyrene, polyvinyltoluene; and styrene-copolymers such as styrene-p-chlorostyrene copolymer, styrene-polypropylene copolymer, styrene-vinyltoluene copolymer, styrene-methylacrylate copolymer, styrene-ethylacrylate copolymer, styrene-butylacrylate copolymer, styrene-$\alpha$-methylchlormethacrylate copolymer, styrene-acrylonitrile copolymer, styrene-vinylmethylether copolymer, styrene-vinylmethylketone copolymer,styrene-butadiene copolymer, styrene-isoprene copolymer, styrene-maleic acid copolymer, and styrene-maleate copolymer.

The polyester resin which is a polycondensation product of a polyhydric alcohol and a polybasic acid can reduce melt viscosity of the toner while maintaining storage stability thereof. Examples of polyhydric alcohols include diols such as polyethylene glycol, diethylene glycol, triethylene glycol 1,2-propylene glycol, 1,3-propylene glycol, 1,4-propylene glycol, neopentyl alycol, and 1,4-butenediole; bisphenol A etherificated such as 1,4-bis(hydroxymethyl)cyclohexane, hydrogenated bisphenol A, bis(polyoxyethylene phenyl) propane, bis(polyoxymethylene phenyl)propane; dihydric alcohol monomers formed by the substitution thereof with a saturated or unsaturated hydrocarbon group having 3–22 carbon atoms, and other dihydric alcohol monomers; trihydric or higher alcohol monomers such as sorbitol, 1,2,3,6-hexane tetrol, 1,4-sorbitan, pentaerythritol, dipentaerythritol, tripentaerythritol, cane sugar, 1,2,4-butanetriole, 1,2,5-pentanetriole, glycerol, 2-methyl propanetriole, 2-metyl-1,2,4-butanetriole, trimetylolethane, trimetylolpropane, and 1,3,5-trihydroxymethylbenzene.

Examples of the polybasic carboxylic acid include: monocarboxylic acid such as palmitic acid, stearic acid, and oleic acid; dibasic organic acid monomers such as maleic acid, fumalic acid, mesaconic acid, citraconic acid, terephthalic acid, cylclohexane dicarboxycylic acid, succinic acid, adipic acid, sebatic acid, malonic acid, dibasic acid monomers formed by the substitution thereof with a saturated or unsaturated hydrocarbon group having 3–22 carbon atoms, anhydrides thereof, and a dimer formed between low alkylester and linoleic acid; tribasic or higher acid monomers such as 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxypropane, and tetra(methylenecarboxyl)methane, 1,2,7,8-octanetetracarboxylic acid Enbol timer acid and anhydrides thereof.

Examples of the epoxy resins include polycondensation products between bisphenol A and epochlorohydrin, which are commercially available as Epomick R362, R364, R365, R366, R367 and R369 from Mitsui Petrochemical Co. Japan; YD-011, YD-012, YD-014, YD-904 and YD-017 from Toto Chemical Co. Japan; and Epocoat 1002, 1004 and 1007 from Shell Chemical Japan Co.

Illustrative of suitable coloring agents are carbon black, lamp black, iron black, ultramarine, nigrosine, aniline blue, phthalocyanine blue, Hansa Yellow G, Rhodamine 6G, lake, chalcone blue, Chrome Yellow, quinacridone, Benzidine Yellow, Rose Bengale, triallylmethane dyes, mono-azo or diazo pigments, and other known dyes and pigments. These materials may be used individually or in combination.

In the case of a magnetic toner, fine particles of ferromagnetic materials such as iron and cobalt, magnetite, hematite, Li ferrite, Mn—Zn ferrite, Cu—Zn ferrite, Ni—Zn ferrite, Ba ferrite and Mn ferrite may be incorporated into the toner.

For the purpose of controlling triboelectricity of the toner, a charge controlling agent may be incorporated into the toner. Examples of the charge controlling agent include organic metal complexes and chelate compounds such as a metal complex of a mono-azo dye; humic or nitrohumic acid or a salt thereof; metal complexes (e.g. Co, Cr, and Fe metal complexes) of aromatic hydroxycarboxylic or dicarboxylic acids such as salicylic acid, naphthoic acid and dicarboxylic acid; a quarternary ammonium compound; or an organic dye such as triphenylmethane dyes and nigrosine dyes.

If desired, the toner can contain a releasing agent, such as a low molecular weight polypropylene, a low molecular weight polyethylene, carnauba wax, micro-crystalline wax, jojoba wax, rice wax or montan wax.

It is desirable that the toner have sufficient fluidity and can be transferred to a latent image bearing surface without fail. To this end, a fluidity improving agent such as hydrophobic metal oxide powder (e.g. hydrophobic silica or titania), a lubricant such as organic polymer powder (e.g. polytetrafluoroethylene) or metal soap (e.g. zinc stearate), a polishing agent (e.g. cerium oxide or silicon carbide), or a caking-preventing agent may be added into the toner.

The two-components developer according to the present invention can be used for developing an electrostatic latent image with any known image forming device. In this case, it is preferred that the developer be supported on a developing roller or sleeve to which an alternate electric voltage is applied as a developing bias for reasons of obtaining a high image density with small variation of dot diameters and with good highlight reproducibility. The AC voltage may be overlapped with a DC voltage.

The following examples will further illustrate the present invention. Parts are by weight.

TONER PREPARATION EXAMPLE 1

| | |
|---|---|
| Polyester resin | 60 part |
| Styrene acrylic resin | 25 parts |
| Carnauba wax | 5 parts |
| Carbon black | 10 parts |
| Cromium-containing azo compound | 3 parts |

The above components were thoroughly mixed with each other and then melted and kneaded with a two-roller kneader. After cooling, the resulting lumps were coarsely pulverized with a cutter mill, finely pulverized with a high speed air-flow pulverizer, and classified with an air classifier to obtain raw toner particles having a volume average particle diameter of 8.3 $\mu$m and a true specific gravity of 1.25 g/cm$^3$. The raw toner particles (100 parts) were then blended with 0.7 part of hydrophobic silica fine particles (R972 manufactured by Nippon Aerosil Inc.) using a Henschel mixer to obtain Toner No. I.

TONER PREPARATION EXAMPLE 2

Above Toner Preparation Example 1 was repeated in the same manner as described except that the classification with the air classifier was performed to obtain raw toner particles having a volume average particle diameter of 5.8 $\mu$m and a true specific gravity of 1.25 g/cm$^3$. The raw toner particles (100 parts) were then blended with 0.7 part of hydrophobic silica fine particles (R972 manufactured by Nippon Aerosil Inc.) using a Henschel mixer to obtain Toner No. II.

CARRIER PREPARATION EXAMPLE 1

A silicone resin (SR2411 manufactured by Toray Dow-Corning Inc.) was diluted to obtain a coating liquid having a solid matter content of 5% by weight. Carrier Core No. (1) (Cu—Zn ferrite particles, 5 Kg) having properties (weight average particle diameter Dv, number average particle diameter Dp, amount of particles with a particle diameter of less than 44 $\mu$m, amount of particles with particle diameter of less than 22 $\mu$m, Dv/Dp, and magnetic moment when applied with a magnetic field of 1 KOe) as shown in Table 1-1 was coated with the above coating liquid at a rate of about 40 g/min using a fluidized bed coating apparatus at 100° C. The coated particles were then heated at 270° C. for 2 hours to obtain Carrier A having a thickness of the coating of 0.43 $\mu$m, an electric resistance LogR of 15.2 Ω·cm (R=$10^{15.2}$ Ω·cm) and a true density of 5.0 g/cm$^3$. The thickness of the resin coating was controlled by the amount of the coating liquid used. In Tables 1-1 and 1-2, magnetic moment is measured with B-H tracer (BHU-60 manufactured by Riken Electronics Inc.).

CARRIER PREPARATION EXAMPLE 2

Carrier Preparation Example 1 was repeated in the same manner as described except that Carrier Core No. (2) (Cu—Zn ferrite particles) having properties as shown in Table 1-1 was substituted for Carrier Core No. (1), thereby to obtain Carrier B having a true density of 5.0 g/cm$^3$. The thickness of the coating, electric resistance of Carrier B are shown in Table 1-1.

CARRIER PREPARATION EXAMPLE 3

Carrier Preparation Example 1 was repeated in the same manner as described except that Carrier Core No. (3) (Cu—Zn ferrite particles) having properties as shown in Table 1-1 was substituted for Carrier Core No. (1), thereby to obtain Carrier C having a true density of 5.0 g/cm$^3$. The thickness of the coating, electric resistance of Carrier C are shown in Table 1-1.

CARRIER PREPARATION EXAMPLE 4

Carrier Preparation Example 1 was repeated in the same manner as described except that Carrier Core No. (4) (Cu—Zn ferrite particles) having properties as shown in Table 1-1 was substituted for Carrier Core No. (1), thereby to obtain Carrier D having a true density of 5.0 g/cm$^3$. The thickness of the coating, electric resistance of Carrier D are shown in Table 1-1. Carriers B, C and D are comparative products.

CARRIER PREPARATION EXAMPLE 5

A silicone resin (SR2411 manufactured by Toray Dow-Corning Inc.) was diluted to obtain a coating liquid having a solid matter content of 5% by weight. Carrier Core No. (1) (Cu—Zn ferrite particles, 5 Kg) having properties as shown in Table 1-1 was coated with the above coating liquid at a rate of about 40 g/min using a fluidized bed coating apparatus at 100° C. The coated particles were then heated at 230° C. for 2 hours to obtain Carrier E having a true density of 5.0 g/cm$^3$. The thickness of the coating, electric resistance of Carrier E are shown in Table 1-1.

CARRIER PREPARATION EXAMPLE 6

A silicone resin (SR2411 manufactured by Toray Dow-Corning Inc.) was mixed with carbon black (Ketchen Black EC-DJ600 manufactured by Lion Akzo Corporation) with a ball mill for 60 minutes. The amount of the carbon black was 7% by weight based on the resin solid matters of the silicone resin. The mixture was then diluted to obtain a coating liquid having a solid matter content of 5% by weight. Carrier Core No. (1) (Cu—Zn ferrite particles, 5 Kg) having properties as shown in Table 1-1 was coated with the above coating liquid at a rate of about 40 g/min using a fluidized bed coating apparatus at 100° C. The coated particles were then heated at 350° C. for 2 hours to obtain Carrier F having a true density of 5.1 g/cm$^3$. The thickness of the coating, electric resistance of Carrier F are shown in Table 1-1.

CARRIER PREPARATION EXAMPLE 7

Carrier Preparation Example 1 was repeated in the same manner as described except that Carrier Core No. (5) (Cu—

Zn ferrite particles) having properties as shown in Table 1-1 was substituted for Carrier Core No. (1), thereby to obtain Carrier G having a true density of 5.1 g/cm$^3$. The thickness of the coating, electric resistance of Carrier G are shown in Table 1-1.

CARRIER PREPARATION EXAMPLE 8

A silicone resin (SR2411 manufactured by Toray Dow-Corning Inc.) was mixed with carbon black (Ketchen Black EC-DJ600 manufactured by Lion Akzo Corporation) with a ball mill for 60 minutes. The amount of the carbon black was 7% by weight based on the resin solid matters of the silicone resin. The mixture was then diluted to obtain a dispersion having a solid matter content of 5% by weight. The dispersion was then mixed with an aminosilane coupling agent ($NH_2(CH_2)_3Si(OCH_3)_3$) to obtain a coating liquid. The amount of the coupling agent was 3% by weight based on the resin solid matters of the silicone resin. Carrier Core No. (1) (Cu—Zn ferrite particles, 5 Kg) having properties as shown in Table 1-2 was coated with the above coating liquid at a rate of about 40 g/min using a fluidized bed coating apparatus at 100° C. The coated particles were then heated at 200° C. for 2 hours to obtain Carrier H having a true density of 5.1 g/cm$^3$. The thickness of the coating, electric resistance of Carrier H are shown in Table 1-2.

CARRIER PREPARATION EXAMPLE 9

Carrier Preparation Example 1 was repeated in the same manner as described except that Carrier Core No. (6) (Cu—Zn ferrite particles) having properties as shown in Table 1-2 was substituted for Carrier Core No. (1), thereby to obtain Carrier I having a thickness of the coating and an electric resistance as shown in Table 1-2.

CARRIER PREPARATION EXAMPLE 10

Carrier Core No. (4) (5 Kg) having the properties shown in Table 1-1 was treated with a vibration sieving machine equipped with an ultrasonic oscillator for 5 minutes to obtain Carrier Core No. (7) having the properties shown in Table 1-2 with a yield of about 92%. The sieving machine had a construction as shown in FIG. 2. A resonant ring 6 is directly attached to a wire net sieve 5 (635 Tyler mesh) having a diameter of 70 cm supported on a frame 9. The ring 6 is provided with a converter 8 which generates an ultrasonic wave upon receipt of a high frequency current through a cable 7. Sieved product is collected in a cylindrical casing 2 beneath the sieve 5. The casing 2 is supported through spring means 3 by a base 4 in which a motor is accommodated. Carrier Core No. 1 was placed on the sieve 5 and the sieved product (Carrier Core No. 7) was thus collected in the casing 2. No clogging of the sieve was caused.

Using Carrier Core No. 7, the procedure of Carrier Preparation Example 1 was repeated to obtain Carrier J having a thickness of the coating and an electric resistance as shown in Table 1-2.

CARRIER PREPARATION EXAMPLE 11

Carrier D obtained using Carrier Core No. 4 was treated with the vibration sieving machine used in Carrier Preparation Example 10 to obtain Carrier D' having a thickness of the coating and an electric resistance as shown in Table 1-2. No clogging of the sieve was caused.

CARRIER PREPARATION EXAMPLES 12 and 13

Carrier Preparation Example 1 was repeated in the same manner as described except that Carrier Core No. (8) and No. (9) (Mn-ferrite particles) having properties as shown in Table 1-2 were substituted for Carrier Core No. (1), thereby to obtain Carrier K and Carrier L, respectively, having a thickness of the coating and an electric resistance as shown in Table 1-2.

TABLE 1-1

| Carrier Preparation Example No. | 1 | 2 *1 | 3 *1 | 4 *1 | 5 | 6 | 7 |
|---|---|---|---|---|---|---|---|
| Carrier | A | B | C | D | E | F | G |
| Carrier Core No. | (1) | (2) | (3) | (4) | (1) | (1) | (5) |
| Weight Average Particle Diameter (μm) | 36.3 | 41.4 | 34.3 | 35.3 | 36.3 | 36.3 | 35.6 |
| Number Average Particle Diameter (μm) | 29.3 | 33.7 | 27.4 | 22.3 | 29.3 | 29.3 | 29.4 |
| Amount of particles with particle diameter of less than 44 μm (wt. %) | 81.7 | 61.4 | 85.2 | 83.1 | 81.7 | 81.7 | 89.2 |
| Amount of particles with particle diameter of less than 22 μm (wt. %) | 2.6 | 4.3 | 8.1 | 6.3 | 2.6 | 2.6 | 2.0 |
| Dv/Dp | 1.24 | 1.23 | 1.25 | 1.58 | 1.24 | 1.24 | 1.21 |
| Magnetic Moment (emu/g) | 43 | 43 | 42 | 41 | 43 | 43 | 68 |
| Thickness of Resin Coating (μm) | 0.43 | 0.43 | 0.42 | 0.43 | 0.41 | 0.43 | 0.44 |
| Content of Carbon (wt. %) | 0 | 0 | 0 | 0 | 0 | 7 | 0 |
| Content of Aminosilane coupling agent (wt. %) | 0 | 0 | 0 | 0 | 0 | 0 | 0 |
| Resistance of Carrier LogR (Ω · cm) | 15.2 | 15.3 | 15.2 | 15.1 | 15.1 | 13.1 | 15.2 |

*1 Comparative Carrier

TABLE 1-2

| Carrier Preparation Example No. | 8 | 9 | 10 | 11 | 12 | 13 |
|---|---|---|---|---|---|---|
| Carrier | H | I | J | D' | K | L |
| Carrier Core No. | (1) | (6) | (7) | (4) | (8) | (9) |
| Weight Average Particle Diameter Dv (μm) | 36.3 | 34.3 | 36.4 | 36.2 *2 | 35.1 | 35.3 |
| Number Average Particle Diameter Dp (μm) | 29.3 | 27.7 | 32.8 | 31.8 *2 | 28.5 | 28.5 |
| Amount of particles with particle diameter of less than 44 μm (wt. %) | 81.7 | 84.0 | 76.1 | 78.0 *2 | 80.2 | 80.6 |
| Amount of particles with particle diameter of less than 22 μm (wt. %) | 2.6 | 6.6 | 0.2 | 0.4 *2 | 6.5 | 6.7 |
| Dv/Dp | 1.24 | 1.24 | 1.11 | 1.14 *2 | 1.23 | 1.24 |
| Magnetic Moment (emu/g) | 43 | 44 | 41 | 41 | 76 | 85 |
| Thickness of Resin Coating (μm) | 0.44 | 0.44 | 0.43 | 0.43 | 0.44 | 0.43 |
| Content of Carbon (wt. %) | 7 | 0 | 0 | 0 | 0 | 0 |
| Content of Aminosilane coupling agent (wt. %) | 3 | 0 | 0 | 0 | 0 | 0 |
| Resistance of Carrier LogR (Ω · cm) | 12.7 | 15.4 | 15.3 | 15.1 | 15.2 | 15.3 |

*2 Characteristics of carrier with coating

Using the thus obtained carriers, developers were prepared and tested for various characteristics including image quality and reliability. Images were produced on transfer sheet (paper) using a commercially available digital copying and printing apparatus (IMAGIO MF250 manufactured by Ricoh Company, Ltd.) operated under the following conditions:

| | |
|---|---|
| Developing Gap (between photosensitive drum and developing sleeve): | 0.40 mm |
| Doctor Gap (between developing sleeve and doctor blade): | 0.35 mm |
| Photosensitive drum linear velocity: | 90 mm/sec |
| Linear speed ratio of developing sleeve/photosensitive drum: | 2.5 |
| Charge potential (Vd): | −700 V |
| Potential at an image portion (black) after exposure ($V_L$): | −100 V |
| Developing bias: | DC −450 V |

Test methods are as follows:

(1) Image Density

Image densities at five positions in a central region of a black pattern of 30 mm×30 mm size are measured with a McBeth densitometer. The average represents image density (desired image density: at least 1.35).

(2) Background Stain

Stains in the background is evaluated according to 10 ranks ratings. Rank 10 is the best quality with minimum stains (desired rank: at least 8).

(3) Average Dot Diameter and Variance

Dot pattern of 400 DPI (independent dot in both main and sub-scanning) is formed with a printer mode. Dot diameters of 80 dots (5 portions each including 16 dots) are measured to calculate the average and variance σ (desired variance: $\sigma \leqq 0.15$).

(4) Mark of Brush

Mark of magnetic brush in a black pattern obtained while applying a developing bias of 350 V is evaluated according to 10 ranks ratings. Rank 10 is the best quality with minimum brush mark (desired rank: at least 7).

(5) Carrier Deposition

Deposition of a carrier on a photosensitive drum will cause injury of the drum or an image fixation roller, which in turn results in deterioration of image quality. Since not all carrier deposits on the photosensitive drum are transferred to paper, it is difficult to evaluate carrier deposition. Here, carrier deposition is evaluated by observation of the drum itself. Since carrier deposition depends not only on developing bias but also on image patterns, white pattern is used. Thus, all of the image represents background (charge potential: −700 V). The developing bias is changed from DC −450 V (standard) until carrier deposition occurs. The least absolute voltage (Vc) at which carrier deposition starts occurring is measured. The lower Vc is, the lower is a tendency of the carrier (developer) to cause carrier deposition.

(6) Background Stain After 50K Running

Sample developer is subjected to a running test in which 50,000 copies (letter image having image area of 6%) were continuously produced while supplying the toner. The background stain of the last obtained copy is evaluated according to 10 ranks ratings. Rank 10 is the best quality with minimum background stain (desired rank: at least 7).

DEVELOPER PREPARATION EXAMPLE 1

Carrier A (100 parts) and Toner No. I (11.4 parts) were mixed with a ball mill for 20 minutes to form a developer having a covering ratio of 50% and a charging amount of toner of −43 μc/g. The developer was then tested for its characteristics as described above to give the results summarized in Table 2-1. As seen in Table 2-1, the developer gave an image density of 1.38, background stain of rank 8, variance of 0.13, brush mark of rank 8, carrier deposition-causing voltage Vc of 400 V and background stain (after running tests) of rank 7. Thus, high grade prints and copies having a small variation of diameter of dots without background stains even after the running test were obtained.

Comparative Example 1

Carrier B (100 parts) and Toner No. I (10 parts) were mixed with a ball mill for 20 minutes to form a developer having a covering ratio of 50% and a charging amount of toner of −43 μc/g. The developer was then tested for its characteristics as described above to give the results summarized in Table 2-1. As seen in Table 2-1, the developer afforded satisfactory carrier deposition. However, the dot diameter variation and brush mark were unsatisfactory. Further, the running test revealed that background stains were caused. Toner dispersion around a dot image was observed.

DEVELOPER PREPARATION EXAMPLES 2–12

Comparative Examples 2 and 3

Various developers were prepared using various combination of carriers and toners as shown in Tables 2-1 and 2-2 and tested for their characteristics as described above. The results are shown in Tables 2-1 and 2-2. All developers had a covering ratio of 50%. In the case of the developer obtained in Developer Preparation Example 6, the developing bias of DC −450 V in the operation conditions of the digital copying and printing apparatus (IMAGIO MF250 manufactured by Ricoh Company, Ltd.) was changed to AC −450 V (the integrated average of the AC voltage was −450 V) using a rectangular wave of 4 KHz.

TABLE 2-1

| Developer Preparation Example No. | 1 | | | | 2 | 3 | 4 |
|---|---|---|---|---|---|---|---|
| Comparative Example No. | | 1 | 2 | 3 | | | |
| Toner No. | I | I | I | I | I | I | I |
| Weight Average Particle Diameter of Toner (μm) | 8.3 | 8.3 | 8.3 | 8.3 | 8.3 | 8.3 | 8.3 |
| Carrier | A | B | C | D | E | F | G |
| Charging Amount of Toner On Carrier at 50% Covering Ratio | 43 | 43 | 42 | 43 | 32 | 42 | 43 |
| Image Density | 1.38 | 1.36 | 1.37 | 1.38 | 1.41 | 1.42 | 1.38 |
| Background Stain (rank) | 8 | 7 | 6 | 7 | 8 | 9 | 9 |
| Average Dot Diameter (μm) | 48 | 54 | 45 | 44 | 52 | 47 | 51 |
| Variance of Dot Diameter | 0.13 | 0.19 | 0.24 | 0.21 | 0.10 | 0.11 | 0.13 |
| Mark of Brush (rank) | 8 | 6 | 7 | 7 | 8 | 8 | 8 |
| Voltage Vc causing Carrier Deposition (V) | 400 | 400 | 550 | 500 | 380 | 380 | 360 |
| Background Statin after 50K running (rank) | 7 | 6 | 6 | 6 | 7 | 7 | 7 |

TABLE 2-2

| Developer Preparation Example No. | 5 | 6 | 7 | 8 | 9 | 10 | 11 | 12 |
|---|---|---|---|---|---|---|---|---|
| Toner No. | I | I | II | I | I | I | I | I |
| Weight Average Particle Diameter of Toner (μm) | 8.3 | 8.3 | 5.8 | 8.3 | 8.3 | 8.3 | 8.3 | 8.3 |
| Carrier | H | A | A | I | J | D' | K | L |
| Charging Amount of Toner On Carrier at 50% Covering Ratio | 31 | 43 | 45 | 41 | 42 | 43 | 42 | 42 |
| Image Density | 1.46 | 1.45 | 1.37 | 1.37 | 1.39 | 1.38 | 1.39 | 1.4 |
| Background Stain (rank) | 10 | 8 | 8 | 8 | 9 | 9 | 9 | 9 |
| Average Dot Diameter (μm) | 56 | 58 | 43 | 46 | 45 | 45 | 45 | 46 |
| Variance of Dot Diameter | 0.08 | 0.12 | 0.08 | 0.18 | 0.11 | 0.13 | 0.17 | 0.18 |
| Mark of Brush (rank) | 9 | 9 | 9 | 8 | 8 | 8 | 8 | 8 |
| Voltage Vc causing Carrier Deposition (V) | 360 | 440 | 400 | 460 | 360 | 370 | 400 | 320 |
| Background Statin after 50K running (rank) | 8 | 7 | 7 | 7 | 8 | 8 | 8 | 8 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A carrier for an image developer for electrophotography, comprising core particles, and a resin layer covering each of said core particles, wherein said core particles have a weight average particle diameter of Dv which is 25–45 μm and a number average particle diameter of Dp which meets with the following condition:

$$1 \leqq Dv/Dp \leqq 1.3,$$

wherein at least 70% by weight of said core particles have a particle diameter of less than 44 μm, and wherein the amount of said core particles having a particle diameter of less than 22 μm is no more than 7% by weight.

2. A carrier as claimed in claim 1, wherein the amount of said core particles having a particle diameter of less than 22 μm is no more than 3% by weight.

3. A carrier as claimed in claim 1, and having an electric resistance LogR of 14.0 Ω·cm or less.

4. A carrier as claimed in claim 1, wherein said core particles provide a magnetic moment of at least 60 emu/g, when applied with a magnetic field of 1 KOe.

5. A carrier as claimed in claim 1, wherein said core particles provide a magnetic moment of at least 75 emu/g, when applied with a magnetic field of 1 KOe.

6. A carrier as claimed in claim 1, wherein said resin layer comprises a silicone resin containing aminosilane coupling agent.

7. A developer for electrography, comprising a dry toner, and a carrier according to claim 1.

8. A developer as claimed in claim 7, wherein the charging amount of the toner, when used in such an amount as to provide a covering ratio of 50%, is not greater than 35 μc/g.

9. A developer as claimed in claim 7, wherein said toner has a weight average particle diameter of not greater than 6.0 μm.

10. A method of developing an electrostatic latent image, comprising contacting said latent image with a developer according to claim 7.

11. A method as claimed in claim 10, wherein said developer is supported on a developing roller to which an alternate electric voltage is applied as a developing bias.

12. A developer container containing a developer according to claim 7.

13. An image forming apparatus having mounted thereon a developer container according to claim 12.

14. A carrier for an image developer for electrophotography, comprising core particles, and a resin layer covering each of said core particles, wherein the carrier has a weight average particle diameter of Dv which is 25–45 μm and a number average particle diameter of Dp which meets with the following condition:

$$1 \leqq Dv/Dp \leqq 1.3,$$

wherein at least 70% by weight of the carrier have a particle diameter of less than 44 μm, and wherein the amount of the carrier having a particle diameter of less than 22 μm is no more than 7% by weight.

* * * * *